US005321963A

United States Patent [19]

Goldman

[11] Patent Number: 5,321,963

[45] Date of Patent: Jun. 21, 1994

[54] DOOR LOCKING SYSTEM HAVING A SENSOR FOR CONTROLLING ACTIVATING/DEACTIVATING OF A LOCKING DEVICE

[75] Inventor: Ilan Goldman, Herzliya, Israel

[73] Assignee: Ilco Unican Inc., Canada

[21] Appl. No.: 945,387

[22] Filed: Sep. 16, 1992

[30] Foreign Application Priority Data

Oct. 18, 1991 [IL] Israel ..... 099796

[51] Int. Cl.[5] ..... E05B 49/00

[52] U.S. Cl. ..... 70/278; 49/394; 70/DIG. 51; 340/542; 340/825.31

[58] Field of Search ..... 70/DIG. 51, DIG. 59, 70/278; 109/43; 49/394; 340/825.31, 542, 543

[56] References Cited

U.S. PATENT DOCUMENTS

| | | | |
|---|---|---|---|
| 3,398,558 | 8/1968 | Benenati | 70/277 |
| 3,828,340 | 8/1974 | Bauer, Jr. et al. | 340/276 |
| 4,278,968 | 7/1981 | Arnett et al. | 340/545 |
| 4,412,356 | 10/1983 | Klaus et al. | 70/DIG. 51 X |
| 4,453,390 | 6/1984 | Moritz et al. | 70/434 |
| 4,621,452 | 11/1986 | Deeg | 49/28 |
| 4,650,987 | 3/1987 | Schwuchow | 70/DIG. 51 X |
| 4,658,106 | 4/1987 | Makoe | 200/61.64 |
| 4,684,945 | 8/1987 | Sanderford, Jr. | 70/278 X |
| 4,917,022 | 4/1990 | Ogasawara et al. | 109/43 |
| 4,942,747 | 7/1990 | Pinnow | 70/263 |

FOREIGN PATENT DOCUMENTS

| | | | |
|---|---|---|---|
| 1022652 | 12/1977 | Canada . | |
| 2653480 | 4/1991 | France . | |
| 3110276 | 5/1991 | Japan | 70/278 |

*Primary Examiner*—Lloyd A. Gall
*Attorney, Agent, or Firm*—Hill, Steadman & Simpson

[57] ABSTRACT

An electrically operated locking system for doors and the like has an electrically operated locking device installed inside the door. A control device installed outside the door is operatively connected with the locking device. A sensor detects the position of the door with respect to the door mounting by a light activated means electrically coupled to the locking device such that when darkness is sensed, the locking device is activatable to operate the locking unit. When light is sensed, however, the locking device is nonactivatable.

19 Claims, 3 Drawing Sheets

DOOR LOCKING SYSTEM HAVING A SENSOR FOR CONTROLLING ACTIVATING/DEACTIVATING OF A LOCKING DEVICE

BACKGROUND OF THE INVENTION

The present invention generally relates to electrically operated locking systems for doors and the like.

Electrically operated locking systems for doors, for example, safety or security room doors, generally comprise a bolt locking unit installed on the inside of the door which is electrically coupled to a control unit which may be installed on the outside of the door or elsewhere, for example, at a central control room.

The control unit may be any of a variety of types, including those types using magnetic cards or keyed-in pass codes. The function of the control unit is to ensure that only authorized persons may operate the locking unit.

Normally, following input at the control unit, typically by key, numbered combination or password, an electrical pulse or current activates the bolt unit which withdraws the bolt from the door frame to unlock the door or inserts the bolt unit into the door frame to lock the door.

Such electrically operated systems tend to have sensitive internal mechanisms which are easily damaged if attempts are made to operate the bolt unit when the door is open or when it is closed for locking or unlocking thereof, but is not properly seated.

It is known to employ devices, such as micro-switches or relays, which are operatively coupled to the locking system to prevent activation of the bolt unit whenever the system is not ready, and often also to display whether the lock is ready to be activated.

Furthermore, in certain types of systems, these devices are used to automatically operate the locking system upon the slamming of the door.

However, several disadvantages have been experienced with respect to such conventional systems. First, the mounting and installation of the micro-switches and other equivalent devices may be complicated and expensive, mainly because of the high level of precision that is required for the proper functioning thereof. Secondly, even after proper installment, there is always the need for conducting fine adjustment operations. Thirdly, the devices may be damaged or otherwise become malfunctioned during prolonged use or by tampering therewith.

SUMMARY OF THE INVENTION

It is, therefore, an object of the present invention to provide an electrically operated door locking system with an activating sensing device which overcomes some of the above-listed and other deficiencies of the conventional systems.

According to the invention, there is provided an electrically operated locking system for doors and the like comprising an electrically operated locking device installed inside the door, a control device installed outside the door operatively connected with the locking device, and sensing means for detecting the position of the door with respect to the door mounting. The sensing means includes a light activated means electrically coupled to the locking device such that on sensing darkness, the locking device may be activated to operate the locking unit, and on sensing light, the locking device may not be activated.

The light activated means may comprise an optical sensor, such as a photocell. The optical sensor may be installed on the inside, the jamb side or incorporated in the housing of the locking device. These and other further additional features and advantages of the present invention are described, and will be apparent from, the detailed description of the presently preferred embodiments and from the drawings.

DETAILED DESCRIPTION OF THE PRESENTLY PREFERRED EMBODIMENTS

Figure 1A:
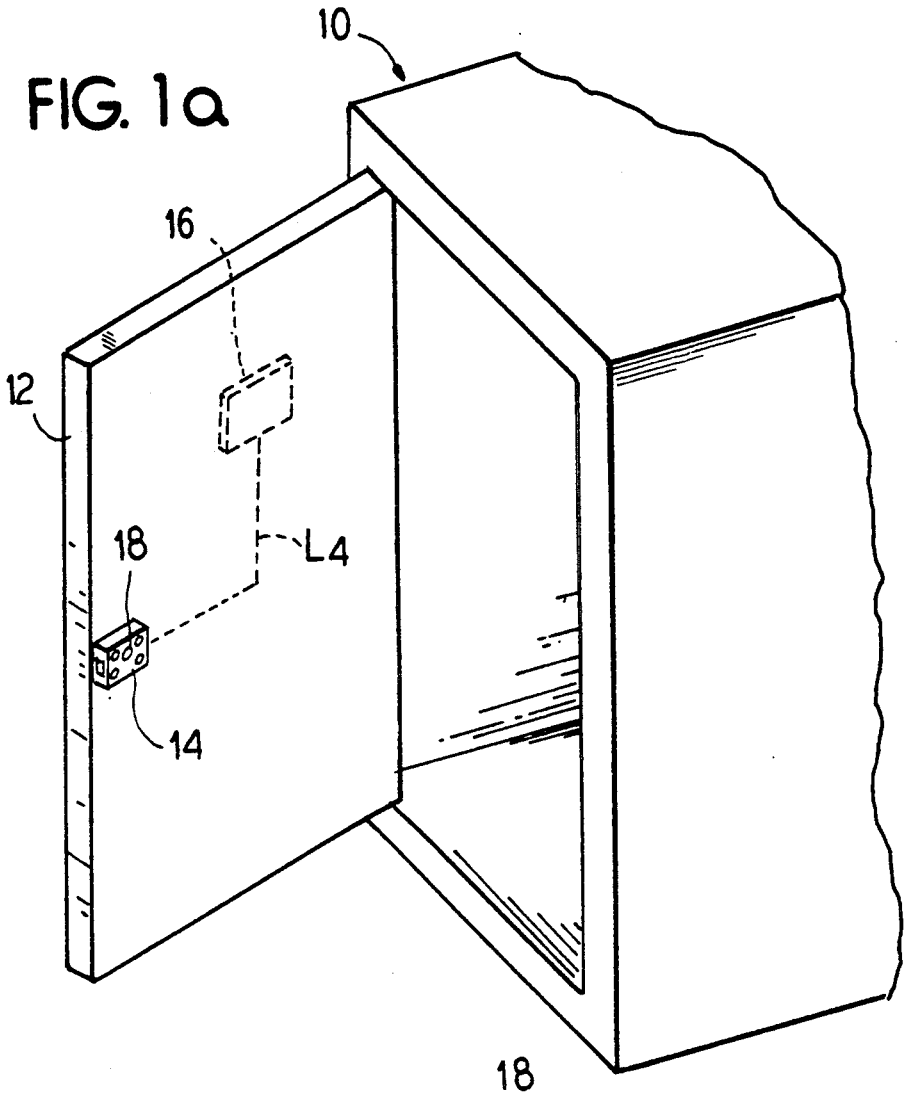
FIG. 1*a* is an internal three-dimensional view of a vault or safe door fitted with a locking device and optical sensor according to a first embodiment of the present invention.
Figure 1B:
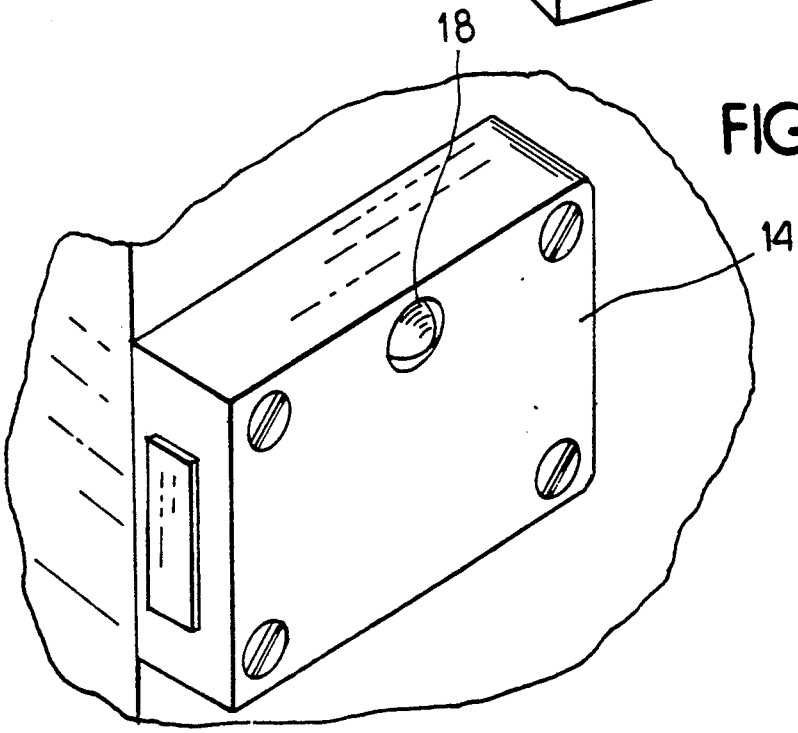
FIG. 1*b* is an exploded view of the locking device and optical sensor as shown in FIG. 1*a*.

Referring to FIGS. 1*a* and 1*b*, there is partly shown a safe or like enclosed space denoted at 10 having a door 12 shown in an open position. As will be readily understood from the following description, the door 12 may be of any known type.

The door 12 may be fitted with a locking device 14 installed inside thereof. A control unit 16 (shown in phantom lines), may be externally fitted to the door 12 and electrically coupled by line $L_4$ to the locking device 14 in any conventional manner (see FIG. 2).

A light sensitive element which may be in the form of an optical sensor 18 is located within the housing of the locking device 14 (or at any other location on the inner surface of the door 12) which faces the inside of the safe 10.

It will be readily understood that since the optical sensor 18 is responsive to light, it can serve as a direct indicator of the door position. When the door 12 is properly closed, there is absence of light, and when door 12 is open, light is present. The optical sensor 18, therefore, functions as a bi-stable activator element responsive to a closed/not closed position of the door 12.

Figure 3:
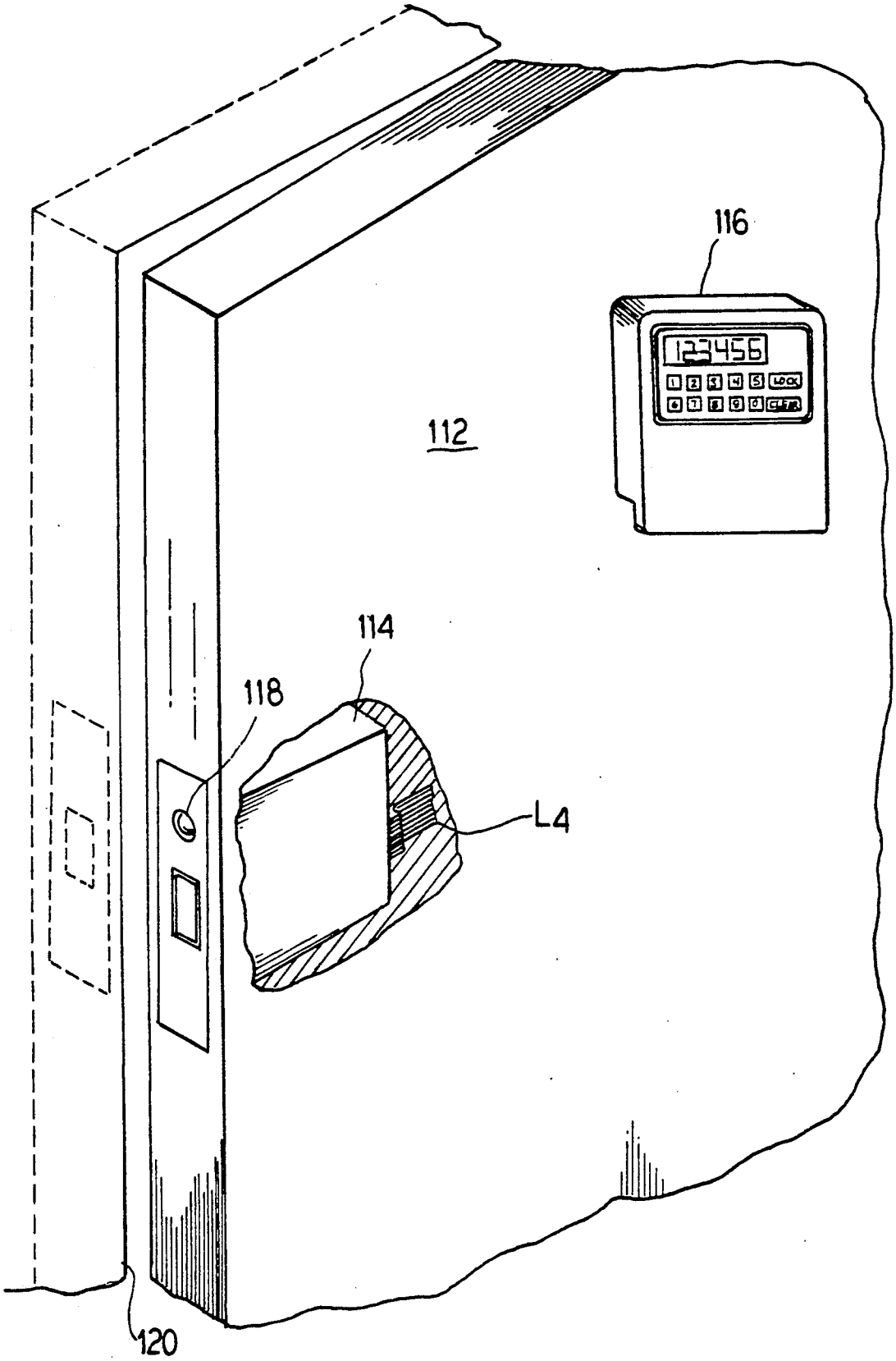
FIG. 3 is a three-dimensional view of a further embodiment of the present invention.

The control unit 116 as shown in FIG. 3 may comprise a visual display to indicate the status of the system, for example, whether the door is open or closed or capable of being locked.

Figure 2:
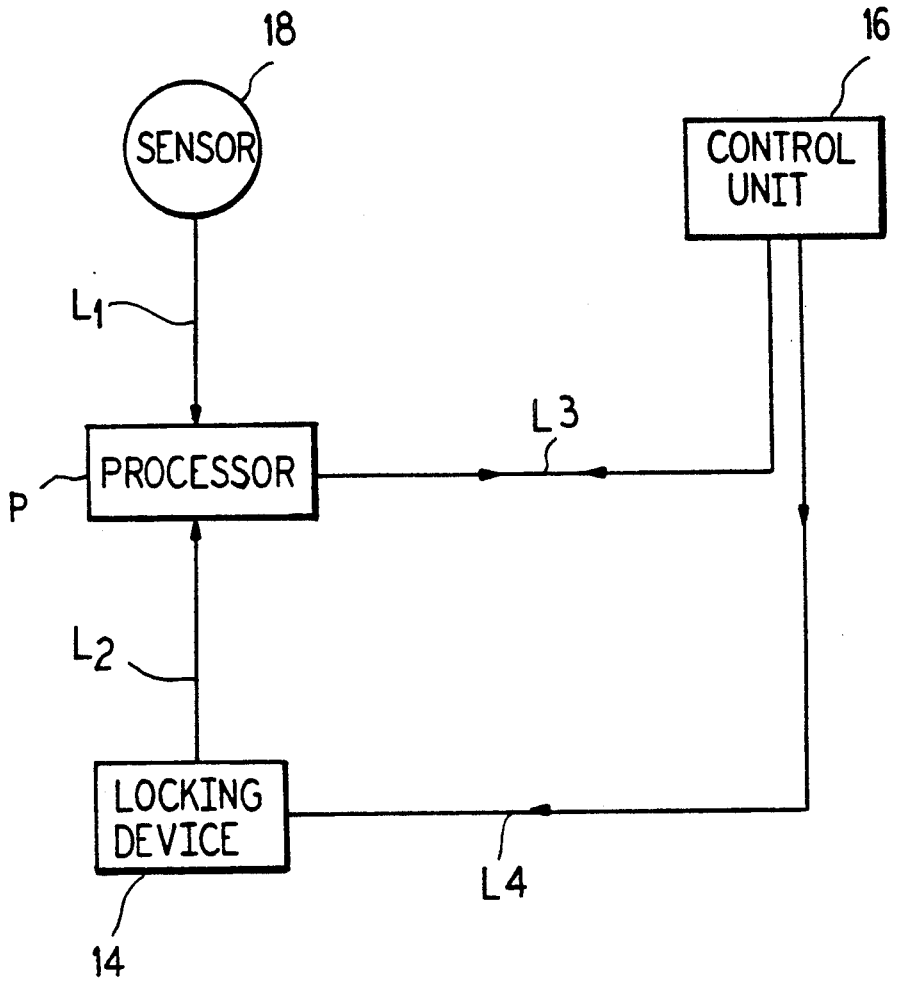
FIG. 2 is a schematic diagram illustrating the operation of the locking system of the present invention.

As shown by the diagram of FIG. 2, the optical sensor 18 is operatively connected to a processor P by way of a coupling represented by a line $L_1$. The processor P is further connected to the control unit 16 and the locking unit 14 by way of couplings represented by lines $L_2$ and $L_3$, respectively. The control unit 16 and the locking unit 14 may be operatively interconnected by the line $L_4$ in the usual manner. It is to be readily understood from the following operational description of the system that line $L_2$ is, in fact, optional.

With the door 12 in an even slightly open position, optical sensor 18 senses the presence of ambient light energy which it converts into electrical pulse. This electrical pulse is transmitted by line $L_1$ and interpreted by the processor P. On the other hand, the processor P constantly receives information from an indicator normally associated with the locking device 14 (an internal micro-switch or the like) about the status thereof, namely being locked or unlocked.

Should the pulse received from the sensor 18 be above a predetermined threshold, a signal is sent by the processor P, via line $L_3$, disabling the locking unit 14 and preventing it from being activated. If the door is "NOT READY FOR LOCKING", this position may be indicated on a visual display associated with the control unit 16. The line $L_3$ also serves to transmit information from the control unit 16 to the processor P.

When the door 12 is fully closed, the optical sensor 18 senses darkness (that is, the absence of light energy) and switches into its second operative state and informs the processor P accordingly. The processor P having received an "OPEN" signal from the locking device 14 may then send a signal via line $L_3$ enabling the control unit 16 and allowing for it to be operated according to its specific requirements (key, password input, etc). If the door is "READY FOR LOCKING/UNLOCKING", this position may be shown on the visual display mentioned above.

Upon correct input at the control unit 16, an electrical current is transmitted to the locking unit 14 via line $L_4$ activating the lock bolt of the device 14 to lock or unlock the safe as required.

In an alternative embodiment, as shown in FIG. 3, the locking unit 114 may be fitted within a door 112 of a security room or even a residential apartment. The door 112 is fitted within a door frame 120. The optical sensor 118 is installed at the jamb side of the door 112 since a "darkness" state prevails only when the door 112 is seated against its door frame 120. The operation of the system is the same as described in connection with the embodiment discussed in FIGS. 1*a*, 1*b* and 2.

As a result, the present invention provides a locking system that is more simple and more reliable than that which has conventionally been used previously.

It should be understood that various changes and modifications to the presently preferred embodiments described herein will be apparent to those skilled in the art. Such changes and modifications can be made without departing from the spirit and scope of the present invention and without diminishing its attendant advantages. It is, therefore, intended that such changes and modifications be covered by the appended claims.

I claim:

1. A method for controlling access to an area behind a door comprising the steps of:

providing a locking device having a locking bolt and a light-activated sensing means;

determining by the light-activated sensing means whether light or no light is present;

inputting an access control code to a control unit mounted outside of the door; and activating the locking bolt thereby controlling access to the area behind the door only in response to no light being sensed and a valid code input by a user.

2. The method of claim 1 further comprising the step of:

preventing access to the area behind the door when light is sensed by the light-activated sensing means.

3. The method of claim 1 further comprising the step of:

preventing access to the area behind the door when an invalid code is input to the control unit by the user.

4. The method of claim 1 further comprising the step of:

installing the locking device on a wall of the door within the area behind the door wherein the sensing means senses no light when the door is closed.

5. The method of claim 1 further comprising the step of:

installing the locking device within the door such that the light-activated sensing means faces a frame head of the door.

6. An electrically operated locking system for doors comprising:

an electrically operated locking device installed inside the door;

a control device installed outside the door operatively connected with said locking device; and sensing means for detecting the position of the door with respect to a mounting for the door wherein said sensing means includes light-activated means electrically coupled to and integral with said locking device such that only upon sensing darkness, said locking device may be activated to operate a locking unit, and upon sensing light, the locking device may not be activated.

7. The system of claim 6 wherein said light-activated means comprises an optical sensor.

8. The system of claim 6 wherein said light-activated means comprises a photoelectric cell.

9. The system of claim 6 wherein said light-activated means is installed on an inside face of said door.

10. The system of claim 9 wherein said light-activated means is incorporated in a locking device housing.

11. The system of claim 6 wherein said light-activated means is installed on a jamb of said door integral with the locking device and facing a frame head of said door.

12. An electrically operated locking system for a door comprising:

a locking device having a sensor and a locking unit integral therewith wherein the locking device is mounted inside the door;

a control device mounted outside the door and operatively connected with the locking device wherein the sensor upon detection of light prevents activation of the locking unit and only upon detection of darkness allows activation of the locking unit.

13. The locking system of claim 12 wherein the sensor is installed to face a frame head of the door.

14. The locking system of claim 12 wherein the sensor is installed to face an enclosed, interior compartment wherein the compartment is dark when the door is closed.

15. The locking system of claim 12 wherein the locking device is installed on an exterior wall of the door within an enclosed, interior compartment wherein the compartment is dark when the door is closed.

16. The locking system of claim 12 wherein the locking device faces a frame head of the door thereby sensing darkness when the door is closed.

17. A locking system for a door comprising:

a locking device having a bolt engaging means and a light-activated sensing means wherein the locking device is integrally constructed with the bolt engaging means and the light-activated sensing means; and a control means installed outside of the door operatively connected with the locking device to activate the bolt engaging means only upon sensing darkness by the light-activated sensing means and upon input of a valid code to the control means by a user.

18. The locking system of claim 17 wherein the locking device is installed inside the door and the light-activated sensing means faces a frame head of the door.

19. The locking system of claim 17 wherein the locking device is installed on the door within an enclosed, interior compartment wherein the compartment is dark when the door is closed.

* * * * *